US006959926B2

(12) United States Patent
Melchiorri

(10) Patent No.: US 6,959,926 B2
(45) Date of Patent: Nov. 1, 2005

(54) GAME BOARD HAVING A BASE FOR UNEVEN SURFACES

(76) Inventor: Fred A. Melchiorri, 3171 Whitney Ave., Apartment 2E, Brooklyn, NY (US) 11229

( * ) Notice: Subject to any disclaimer, the term of this patent is extended or adjusted under 35 U.S.C. 154(b) by 102 days.

(21) Appl. No.: 10/167,605

(22) Filed: Jun. 5, 2002

(65) Prior Publication Data

US 2003/0227135 A1 Dec. 11, 2003

(51) Int. Cl.[7] ..... A63F 3/00

(52) U.S. Cl. ..... 273/287; 273/350; 273/109; 273/457

(58) Field of Search ..... 273/287, 350, 273/309, 109, 454, 460, 459, 139, 136.2, 108.33, 108.41; D21/325; 463/2, 53, 7; 473/116, 15

(56) References Cited

U.S. PATENT DOCUMENTS

| | | | | |
|---|---|---|---|---|
| 1,386,517 A | | 8/1921 | Lellis et al. | |
| 2,051,476 A | | 8/1936 | Grant | |
| 2,163,456 A | | 6/1939 | Youngberg | |
| 2,481,724 A | | 9/1949 | Croteau | |
| 3,117,783 A | | 1/1964 | Reid | |
| 3,372,934 A | | 3/1968 | Heil | |
| 3,778,060 A | | 12/1973 | Lakeman | |
| 3,825,257 A | | 7/1974 | Palmer | |
| 3,874,664 A | | 4/1975 | Faurot et al. | |
| 4,336,942 A | | 6/1982 | Warehime | |
| 4,345,758 A | * | 8/1982 | Kempf | 473/475 |
| 4,354,685 A | | 10/1982 | Hampson | |
| 4,726,592 A | | 2/1988 | Callaham | |
| 4,830,369 A | | 5/1989 | Poitras | |
| 5,029,873 A | | 7/1991 | Davis | |
| 5,452,902 A | | 9/1995 | Foster et al. | |
| 6,299,172 B1 | * | 10/2001 | McMurray | 273/348.4 |

* cited by examiner

*Primary Examiner*—Vishu K. Mendiratta
(74) *Attorney, Agent, or Firm*—Darby & Darby

(57) ABSTRACT

A game device includes a housing defining an interior chamber and the housing has a top surface. The game device also includes a gaming surface integral to the top surface. A leg is slidably connected to the housing and the leg is moveable between a first position interior to the housing and a second position, at least partially exterior to the housing. A base element is selectively disposed within the interior chamber of the housing. The base element has a portion extending exterior to the housing and engages with the variable surface to support the housing. The base element may further include a flexible container. The container defines a second interior chamber and the container may conform to the interior chamber of the housing. The second interior chamber may be filled with a stabilizing material which may determine the range of variable surfaces the game device can be placed on.

51 Claims, 11 Drawing Sheets

GAME BOARD HAVING A BASE FOR UNEVEN SURFACES

BACKGROUND OF THE INVENTION

1. Field of the Invention

The present invention relates to a game with a base that can be placed on many types of surfaces. More specifically, the present invention relates to a game having a base that can be placed indoors, on uneven ground, sand and water and still allow for the game to be played by stabilizing the game surface.

2. Discussion of the Related Art

Various types of games that require a playing surface and a base are known in the art. Each game base is usually designed for a specific environment and may not be able to be utilized in a different setting. For example, many games designed for use on land cannot then be used on or in the water. The reverse is also true, games designed for use on or in water usually cannot be played the same way outside the water. Other examples are game bases that cannot be used on uneven surfaces, like batting tees. Still other games cannot be played without staking the apparatus into a shifting surface, like sand, and then still be utilized indoors. This is because the base cannot be staked through a floor.

In particular, games requiring tossing objects to hit a specific target are typically environment specific. Some examples where the games are surface/environmental specific are, darts, lawn darts, tennis, badminton, and horseshoes. It is well known that all of these games can be played indoors and outdoors and on land and in the water. However, it is also well known that a separate set of equipment is required to play in each environment. An example is that the "land" version of horseshoes would not be able to be played on water.

Thus, there is still a need in the art to develop a game and base which can be played at many locations on many different types of surfaces using the same equipment across all surfaces and environments.

SUMMARY OF THE INVENTION

It is the foregoing and various other drawbacks of the prior art which the present invention seeks to overcome by providing a game device for playing on a variable surface. The game device includes a housing defining an interior chamber and the housing has a top surface. The game device also includes a gaming surface integral to the top surface of the housing. A leg is slidably connected to the housing and the leg is moveable between a first position interior to the housing and a second position, at least partially exterior to the housing.

Also, a base element is selectively disposed within the interior chamber of the housing. The base element has a portion extending exterior to the housing and engages with the variable surface to support the housing. The base element may further include a flexible container. The container defines a second interior chamber and the container may conform to the interior chamber of the housing. The second interior chamber of the container may be filled with a stabilizing material. The selection of a stabilizing material may determine the range of variable surfaces the game device can be placed on.

BRIEF DESCRIPTION OF THE DRAWING FIGURES

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PREFERRED EMBODIMENT

Figure 1:
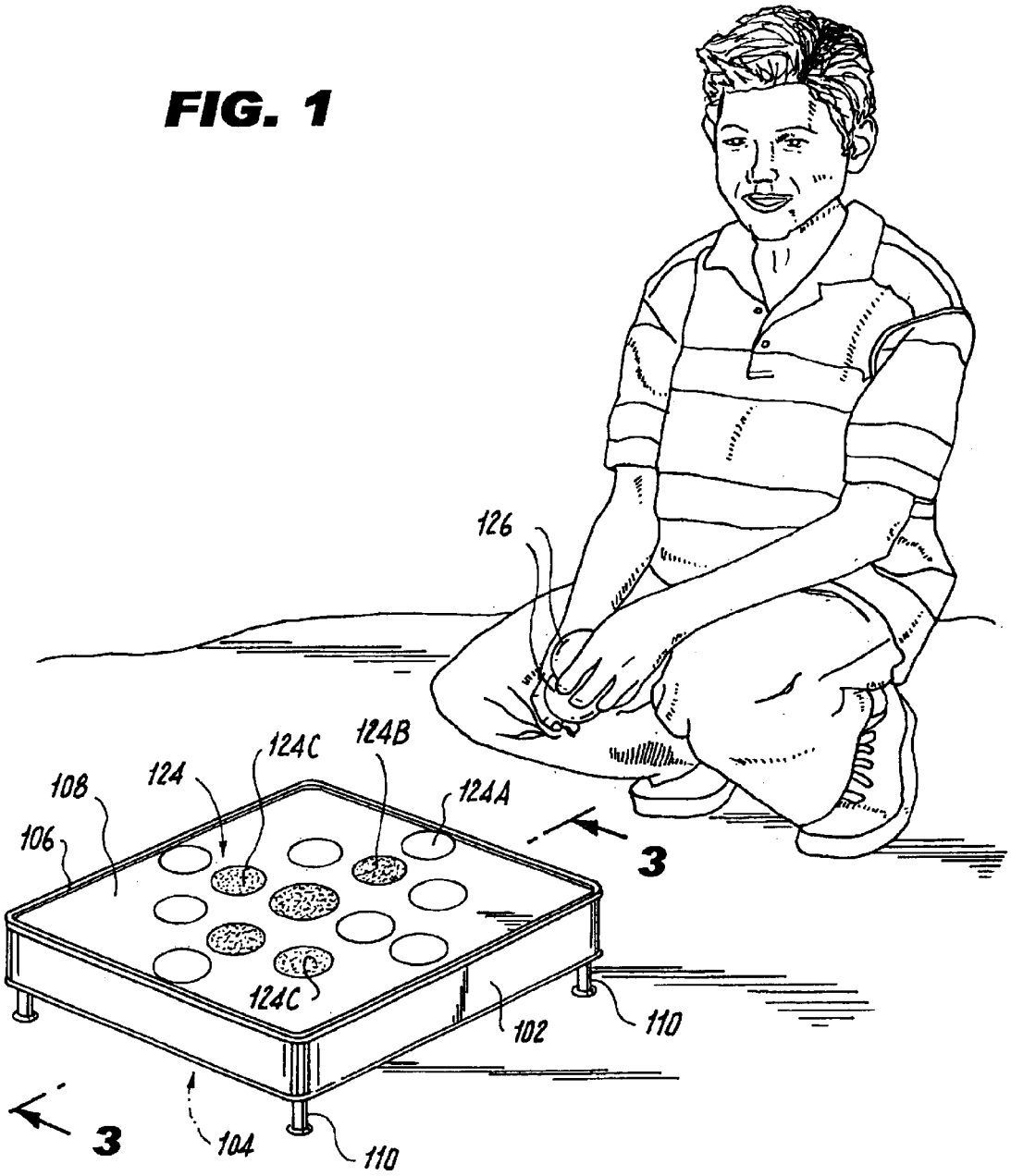
FIG. 1 is a front and side perspective view of the game and base according to one embodiment of the present invention.
Figure 16A:
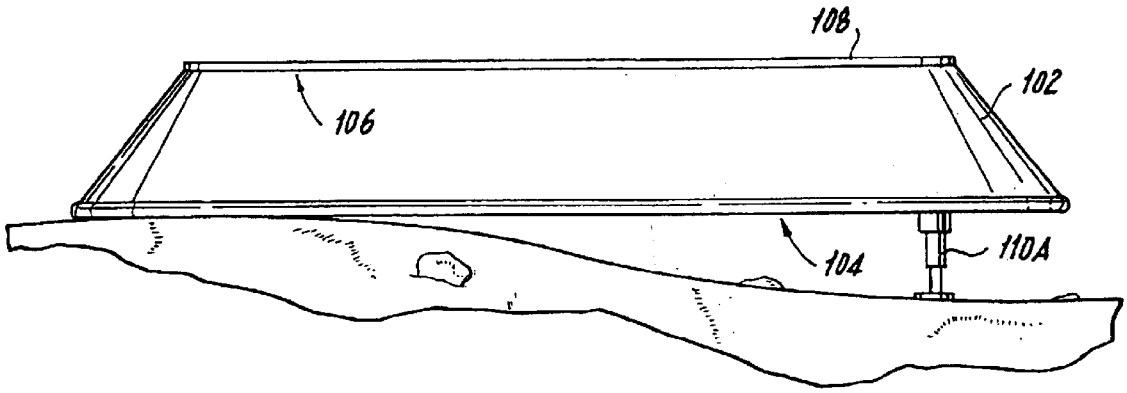
FIGS. 16A–16C are front and side perspective views of the invention engaging various surfaces.
Figure 16B:
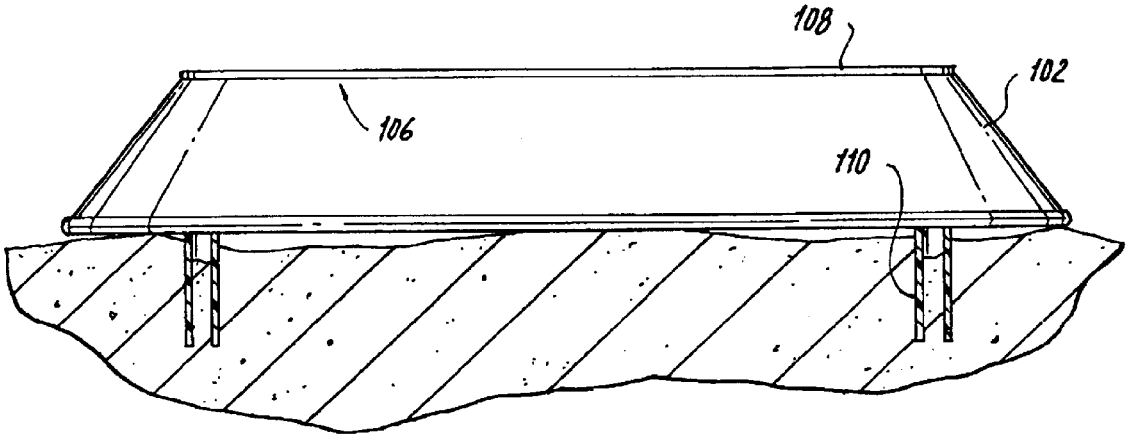
Figure 16C:
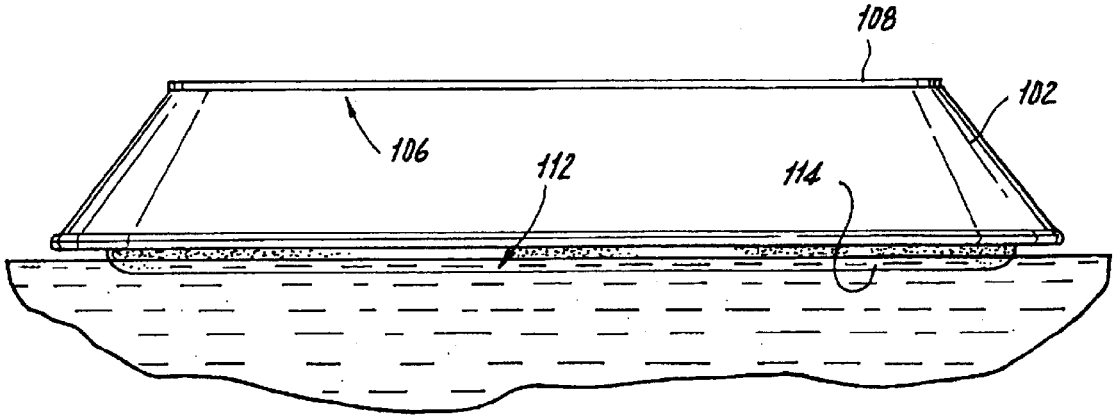
Figure 17:
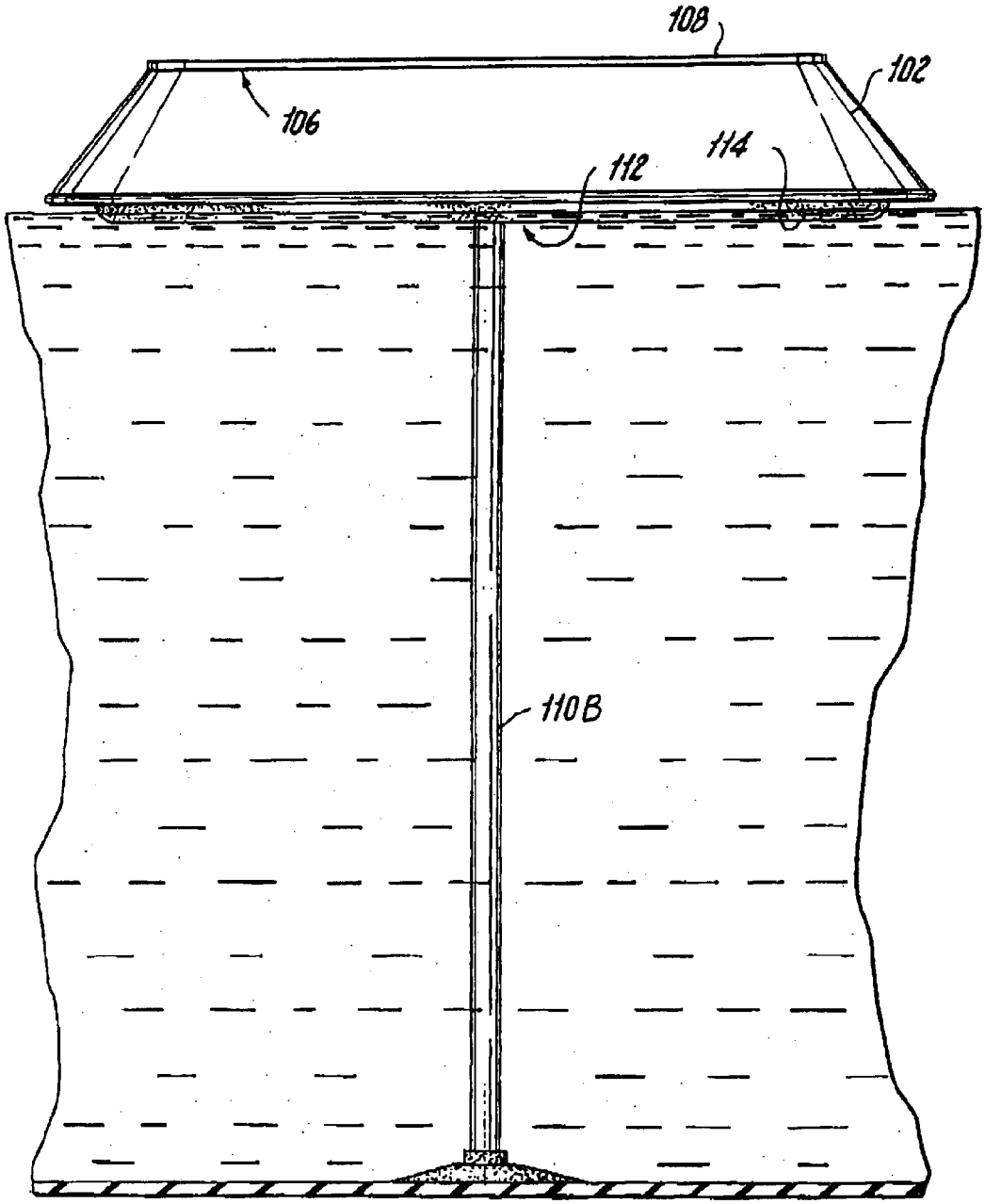
FIG. 17 is a side view of another leg embodiment of the present invention.

Referring now to FIGS. 1–16, a game device 100 for playing on a variable surface in accordance with the present invention is illustrated. FIG. 1 illustrates a game device 100 includes a housing 102 defining an interior chamber 104. Housing 102 has a top surface 106. Game device 100 also includes a gaming surface 108 integral to the top surface 106 of the housing 102. A leg 110 is slidably connected to the housing 102 and the leg is moveable between a first position (see FIG. 16C) interior to the housing and a second position (see FIG. 16A) at least partially exterior to the housing 102. Leg 110 may also be telescopic 110A in certain embodiments (see FIG. 16A). Leg 110 may also anchor the game device 100 to the bottom of a pool using a weight or suction device (see FIG. 17, 110B). Also, a base element 112 is selectively disposed within the interior chamber 104 of the housing 102. Base element 112 has a portion extending exterior to the housing 102 and engages with the variable surface to support the housing 102.

Figure 2:
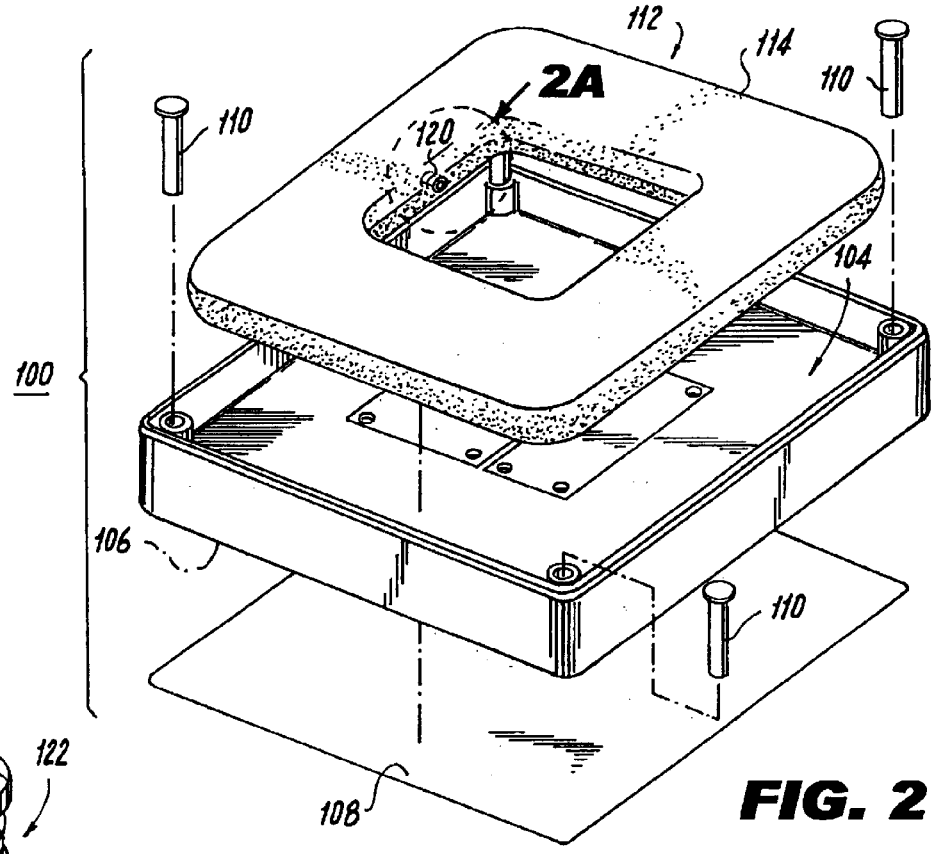
FIG. 2 is a front and side perspective exploded view of the game of FIG. 1.
Figure 2A:
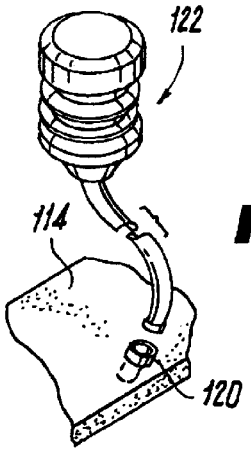
FIG. 2A is an enlarged detail of circle 2A from FIG. 2.
Figure 3:
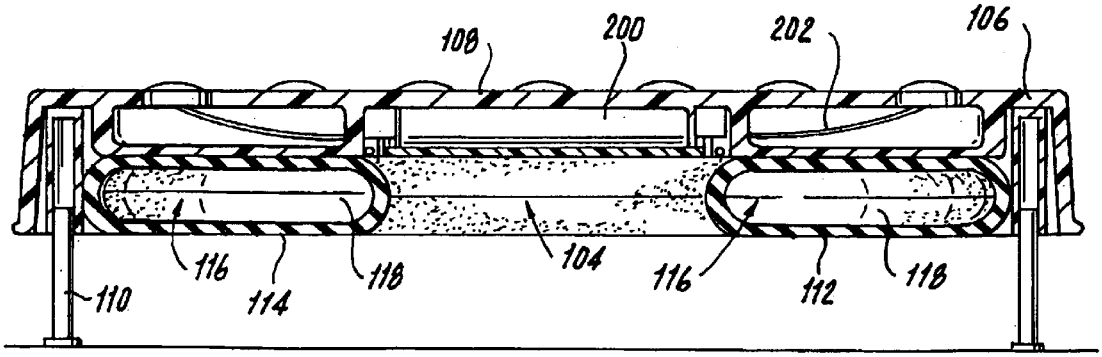
FIG. 3 is a cross-sectional view of the game taken along line 3—3 of FIG. 1 and looking in the direction of the arrows.

Referring now to FIGS. 2, 2A and 3, a base element 112 may further include a flexible container 114. The container 114 defines a second interior chamber 116 and the container 114 may conform to the interior chamber 104 of the housing 102. The second interior chamber 116 of the container 114 may be filled with a stabilizing material 118. Stabilizing material 118 is selected from the group comprising sand, a solid, a granular material, a positively buoyant material, a liquid, a viscoelastic gel and a gas. The selection of a stabilizing material 118 may determine the range of variable surfaces the game device 100 can be placed on. A currently preferred stabilizing material 118 is a granular material. In another preferred embodiment, the stabilizing material 118 is air and the container 114 further includes a valve 120. The valve 120 has a open position and a closed position and the open position allows for the passage of air and the closed position will restrict the passage of air. Additionally, the valve 120 may also include an air compression unit 122 to force air through the valve 120. The air compression unit 122 can be manual or battery operated and may be used to inflate and deflate the flexible container 114 (see FIG. 2A).

Embodiments utilizing air or other positively buoyant stabilizing material 118 may allow the game device 100 to float on water (see FIG. 16C), especially a pool or other man-made body of water. Additionally, to assist in the flotation of the game device 100, the housing 102 may also be positively buoyant.

In another preferred embodiment, the stabilizing material 118 may be a buoyant granule plastic (similar to Styrofoam). The granular nature of the material allows the flexible container 114 to vary in shape and form easily and, thus, allows the base element 112 to conform to variable surfaces. The same shape conforming benefits may also be obtained by using a liquid or viscoelastic gel.

The object of the base element 112, in all of the above embodiments, is to stabilize the game device 100. This stabilization substantially levels the game device 100 in a horizontal plane regardless of the roughness of the underlying surface.

The flexible container 114 can be any shape, however, in a preferred embodiment the flexible container 114 has a toroidal shape. This shape allows the flexible container 114 to be disposed within the interior chamber 104 of the housing 102 and still allow access to portions of the interior chamber 104, these other portions may include the power supply 200 or electronics 202 (see FIG. 3).

As illustrated in FIG. 1, the gaming surface 108 includes a plurality of contact surfaces 124, which are disposed in a pattern and the contact surfaces 124 have a neutral position 124A, a positive position 124B and a negative position 124C. The contact surfaces 124 are pressure sensitive and the pressure causes the contact surfaces 124 to switch between the positions (e.g., neutral 124A to positive 124B). In a preferred embodiment, the pressure to the contact surfaces is applied by a ball 126. The user throws a ball 126 and hits the contact surfaces 124 during the course of game play. It is understood that the pressure may be applied using various objects including shafts, projectiles, or direct human contact. In accordance with another embodiment, the gaming surface 108 and the contact surfaces 124 form a substantially smooth and substantially even surface. The smooth surface facilitates the ball 126 traveling in a substantially predictable trajectory after contact with the gaming surface 108.

In further preferred embodiments, the contact surfaces 124 are electro-mechanical and include a plurality of indicators (not illustrated). The indicators include a plurality of colored lights (not illustrated) and one light color may indicate one of the above positions (e.g., red for neutral 124A, and blue for negative 124C). Additionally, the contact surfaces may also include a plurality of sound generating elements (not illustrated) and each position may generate a distinct sound from the sound generating element. Also, a method for tallying a score (not illustrated) may be included, and this method may be effected manually or electronically. Score may be recorded automatically whenever a contact surface 124 changes position.

Figure 4:
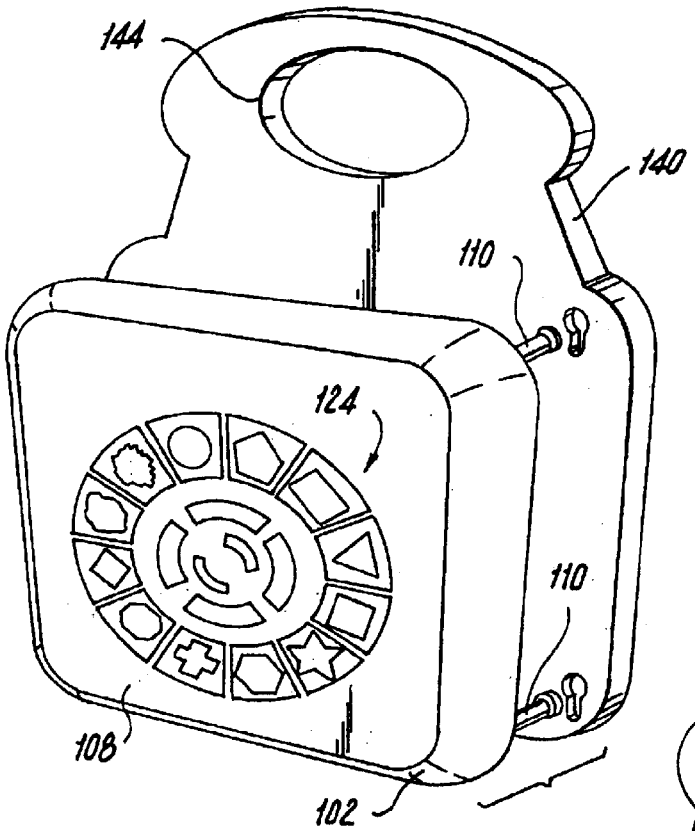
FIG. 4 is a front and side perspective view of another embodiment of the present invention.
Figure 5:
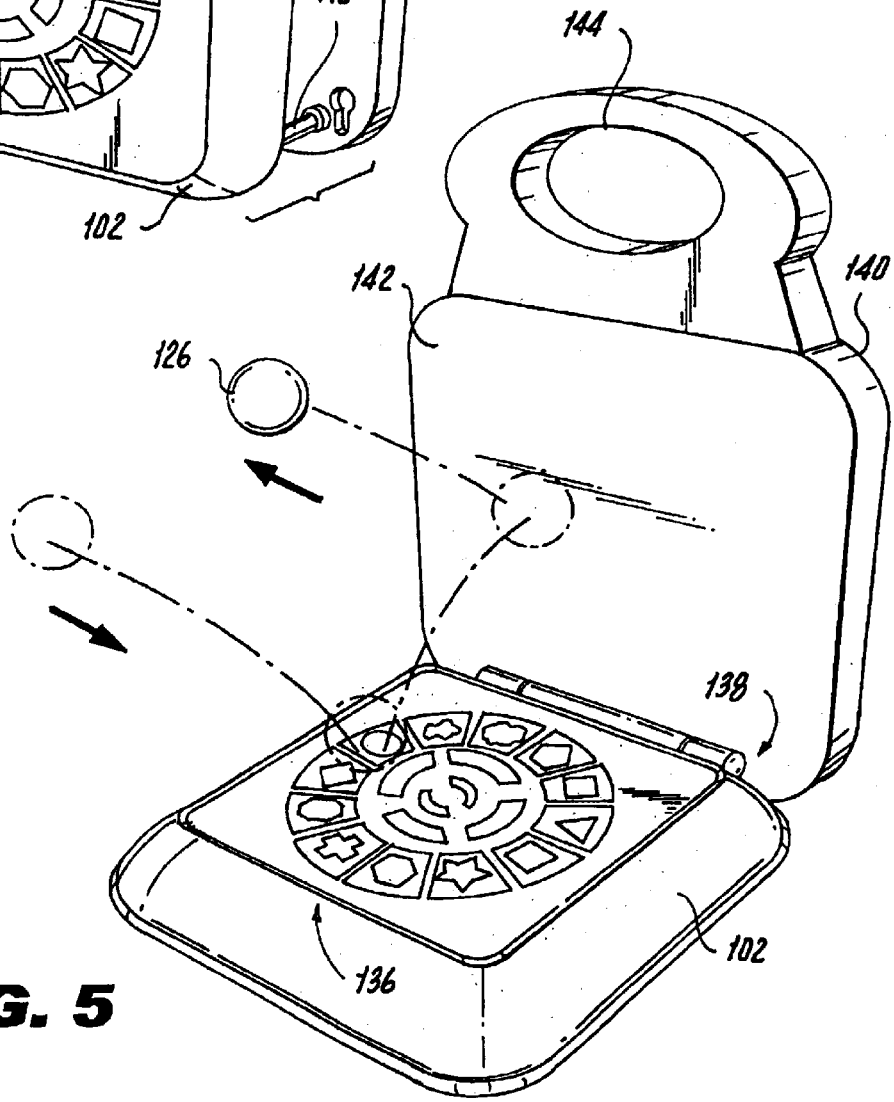
FIG. 5 is a front and side perspective view of another embodiment of the present invention, shown in use.

Referring to FIGS. 4 and 5, the contact surfaces 124 are also shaped, the shape may be triangles, squares, circles, ovals, polygons, trapezoids, wedges or arc sections. It is appreciated that the above list is non-inclusive and the contact surfaces 124 can be shaped to approximate any 2-dimensional surface or represent any 3-dimensional object. The patterns mentioned above may include the contact surfaces 124 disposed generally in a rectilinear grid or an equal number of equally spaced contact surfaces 124 in a rectilinear grid (see FIGS. 8 and 9). FIGS. 4 and 5 illustrate another preferred pattern, which is a plurality of contact surfaces 124 disposed in a circular formation and further, a second plurality of contact surfaces 124 disposed in a concentric circular formation. Lastly, any circular formation may include a contact element 124 disposed in the center of the circular formation.

Referring now to FIG. 5, an embodiment of the game device 100, the housing 102 also includes a near end 136 and a far end 138 and a backing 140. The backing 140 includes an impact surface 142 and is connected to the far end 138 of the housing 102 so that the impact surface 142 is perpendicular to the gaming surface 108 and is directed toward the near end 136. In actual game play, ball 126 may be rebounded off the impact surface 142 and returned to the user.

Referring now to FIGS. 4–8 and 14–15, the backing 140 may have numerous embodiments. One embodiment is the backing 140 is detachable from the housing 102 and may include a handle 144 (see FIG. 4). The backing 140 may also be engagable to the gaming surface 108 and the backing 140 may partially conceal the gaming surface 108 (see FIG. 5). In reverse, the backing 140 may be engagable to the leg 110 so the backing 140 may partially conceal the interior 104 of the housing 102 (see FIGS. 4 and 8). These embodiments, with or without a handle 144, may be used to store, protect and transport the game device 100.

Figure 6:
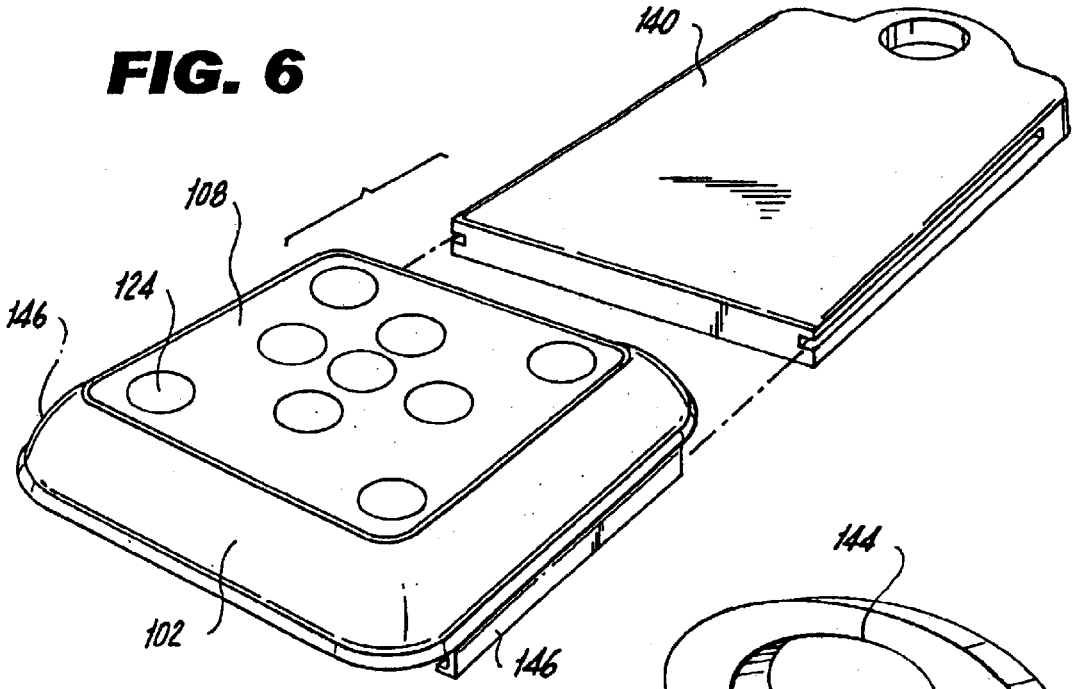
FIG. 6 is a front and side perspective view of another embodiment of the present invention, with an alternate backing embodiment.
Figure 7:
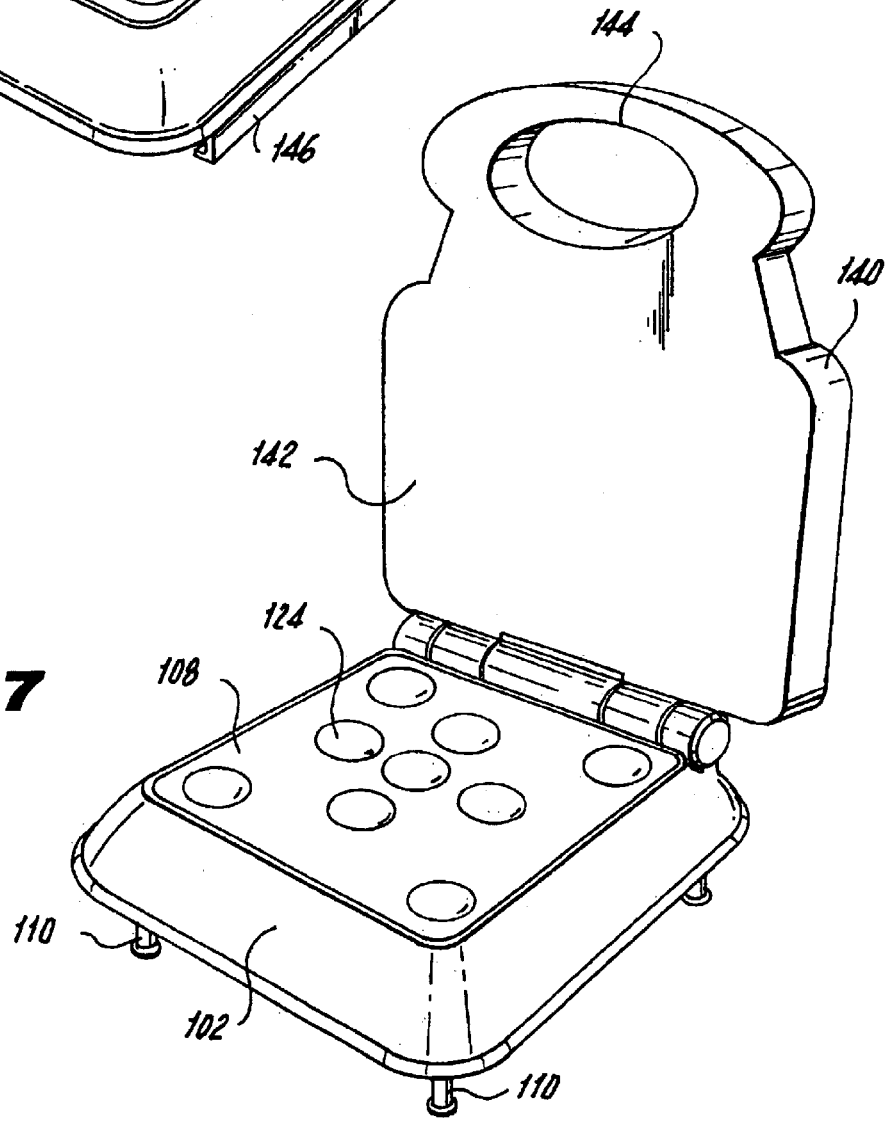
FIG. 7 is a front and side perspective view of another embodiment of the present invention, with an alternate backing embodiment.

FIG. 6 illustrates another embodiment that includes the gaming device 100 having slide rails 146 and the backing 140 is slidably connected to the slide rails 146. Another embodiment, illustrated in FIGS. 8 and 14, the backing 140 is concurrently engagable to both the gaming surface 108 and the leg 110 and the backing 140 is also detachable.

Figure 11:
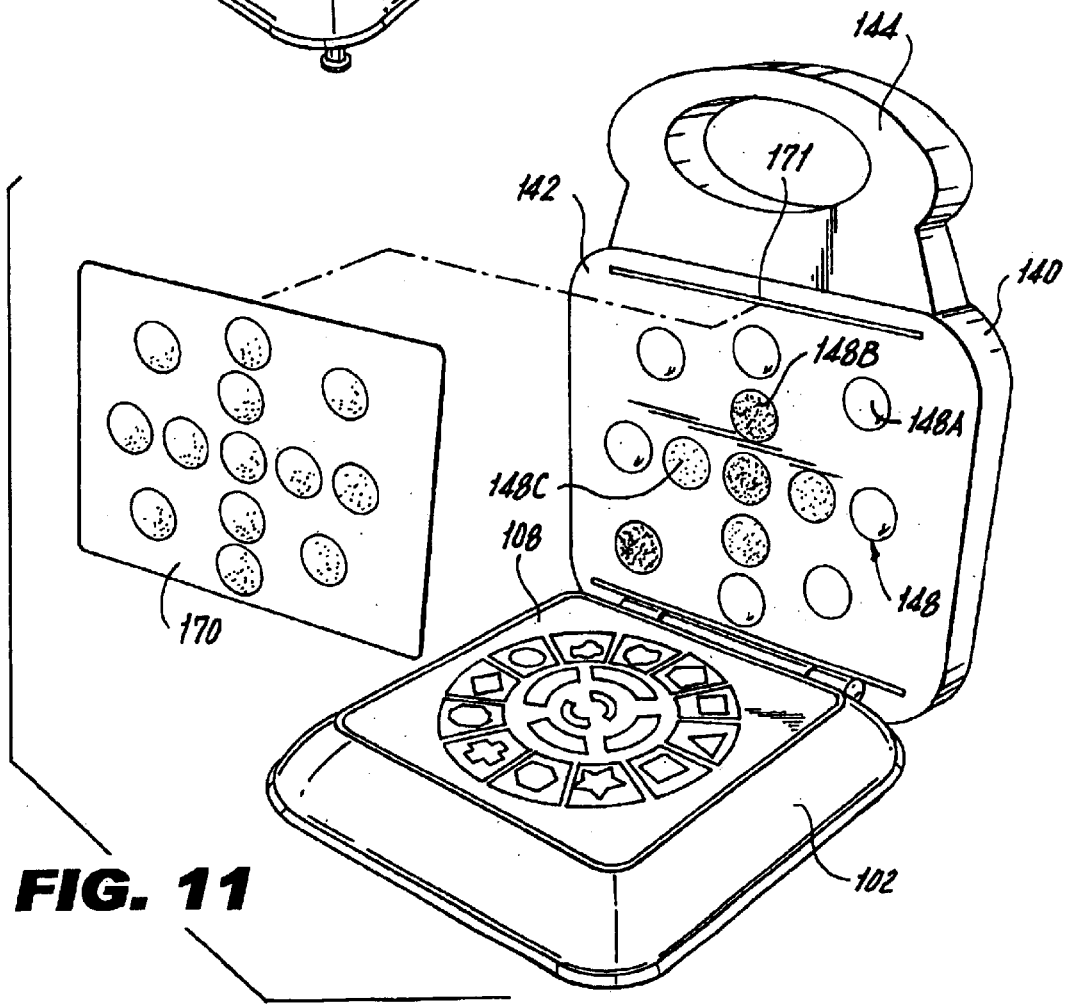
FIG. 11 is a front and side perspective of another embodiment of the present invention.

In the preferred exemplary embodiment illustrated in FIG. 11, the backing 140 is electro-mechanically connected to the gaming surface 108 and also includes a plurality of impact surfaces 148. Impact surfaces 148 are disposed in a pattern. Impact surfaces 148 also have a neutral position 148A, a positive position 148B and a negative position 148C. Impact surfaces 148 may be pressure sensitive and the pressure may cause the impact surfaces 148 to switch between the positions. Using pressure sensitive impact surfaces 148 enhances game play by adding another set of goals or targets to the game play experience.

Figure 9:
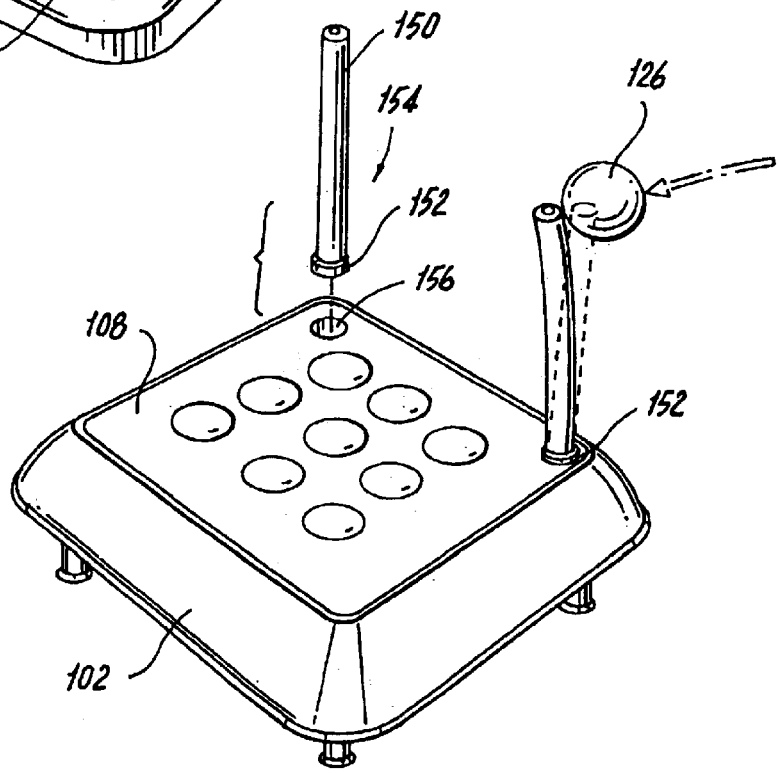
FIG. 9 is a front and side perspective view of another embodiment of the present invention, shown in use.

Another feature of the game device 100, illustrated in FIG. 9, is that the gaming surface 100 may further include a goal post 150. The goal post 150 may be integral to the gaming surface 108 and extends perpendicular to the gaming surface 108 or the goal post 150 may be detachable from the gaming surface 108 and may be disposed within the interior chamber 104 once detached. The goal posts 150 may be more sophisticated and further include a motion sensor 152. Another embodiment is that the goal posts 150 have a fixed end 154 and the housing 104 further includes a socket 156 having a motion sensor 152. When the fixed end 154 of the goal posts 150 is engaged in the socket 156 of the housing 102, the motion of the goal post 150 activates the motion sensor 152 and may trigger an automatic scoring means to record the activation of the sensor. In the above embodiments, an additional element of game play is added. Here the user may now attempt to strike the goal post 150, this will add variety and new challenges to the previous embodiments.

Figure 10:
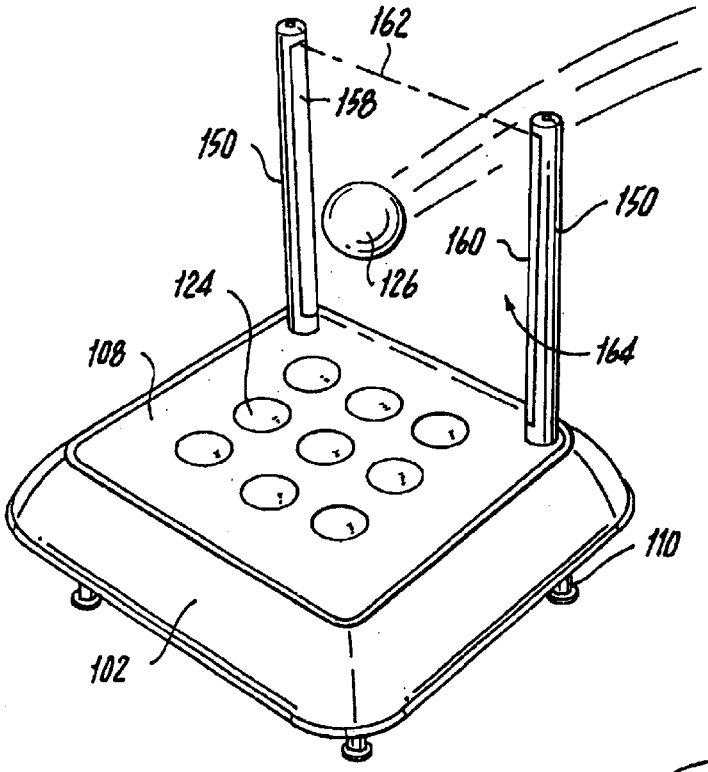
FIG. 10 is a front and side perspective view of another backing embodiment of the present invention, shown in use.

Referring now to FIG. 10, another preferred embodiment may further include one of a focused light emitting element 158 and a focused light reflecting element 160. The focused light emitting element 158 projects a focused beam of light 162 directed at the focused light reflecting element 160 and the beam of light 162 may create a photoelectric barrier 164 between the focused light emitting element 158 and the focused light reflecting element 160. Once the photoelectric barrier 164 is established the focused light emitting element 158 is capable of detecting and signaling when the photoelectric barrier 164 is disturbed and that signal may trigger an automatic scoring means to record the disturbance of the photoelectric barrier 164. The signal may also trigger light generating (not illustrated) or sound generating elements (not illustrated). This again adds further challenges and numerous photoelectric barriers 164 may be created to continually vary game play.

Figure 12:
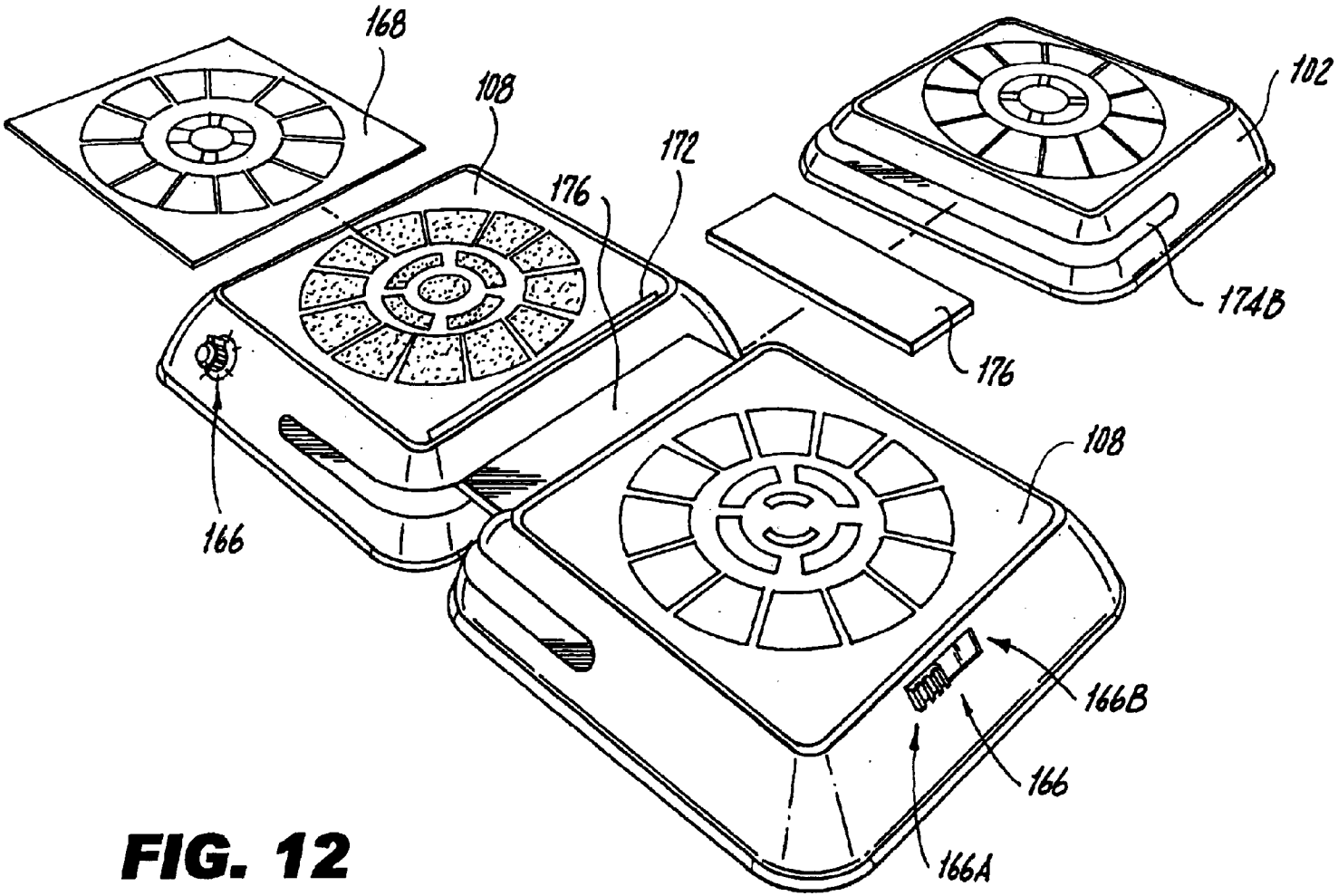
FIG. 12 is a front and side exploded perspective view of another embodiment of the present invention.

FIG. 12 illustrated embodiments that include the housing 102 having a selection element 166 (or switch) that has a first position 166A and a second position 166B. The first position 166A activates the contact surfaces 124 and the second position 166B deactivates the contact surfaces 124. The selection element 166 may have a plurality of positions and each position may alter the pattern of the contact surfaces 124. The alteration occurs because the selection element 166 selectively activates a predefined pattern of contact surfaces 124. These patterns may correspond to different games or skill levels.

Referring now to FIG. 12, the gaming surface 108 now includes a removable surface pattern plate 168 which is removably connected to the gaming surface 108. The removable surface pattern plate 168 comprises a surface pattern and the surface patten is approximately similar to the pattern of the contact surface 124. Additionally, the surface pattern may be approximately similar to the predefined pattern of the contact surfaces 124 as altered by the selection element 166. This matching of the surface pattern to the pattern of the contact elements 124 may also be determined by a surface pattern plate detector 172. The detector 172 is capable of determining the surface pattern on the surface pattern plate 168. Also, the detector 172 may further include a device for selectively activating the contact elements 124 to form a pattern to approximate the surface pattern.

Additionally, as illustrated in FIG. 11, backing 140 further includes a removable backing pattern plate 170 that is also removably connected to the impact surface 142 of the backing 140. The removable backing pattern plate 170 has a backing pattern that is approximately similar to the pattern of the impact surface 142. The backing 140 may also include a backing pattern plate detector 171 which may determine the particular backing pattern that has been placed on the backing pattern plate 170.

Figure 13:
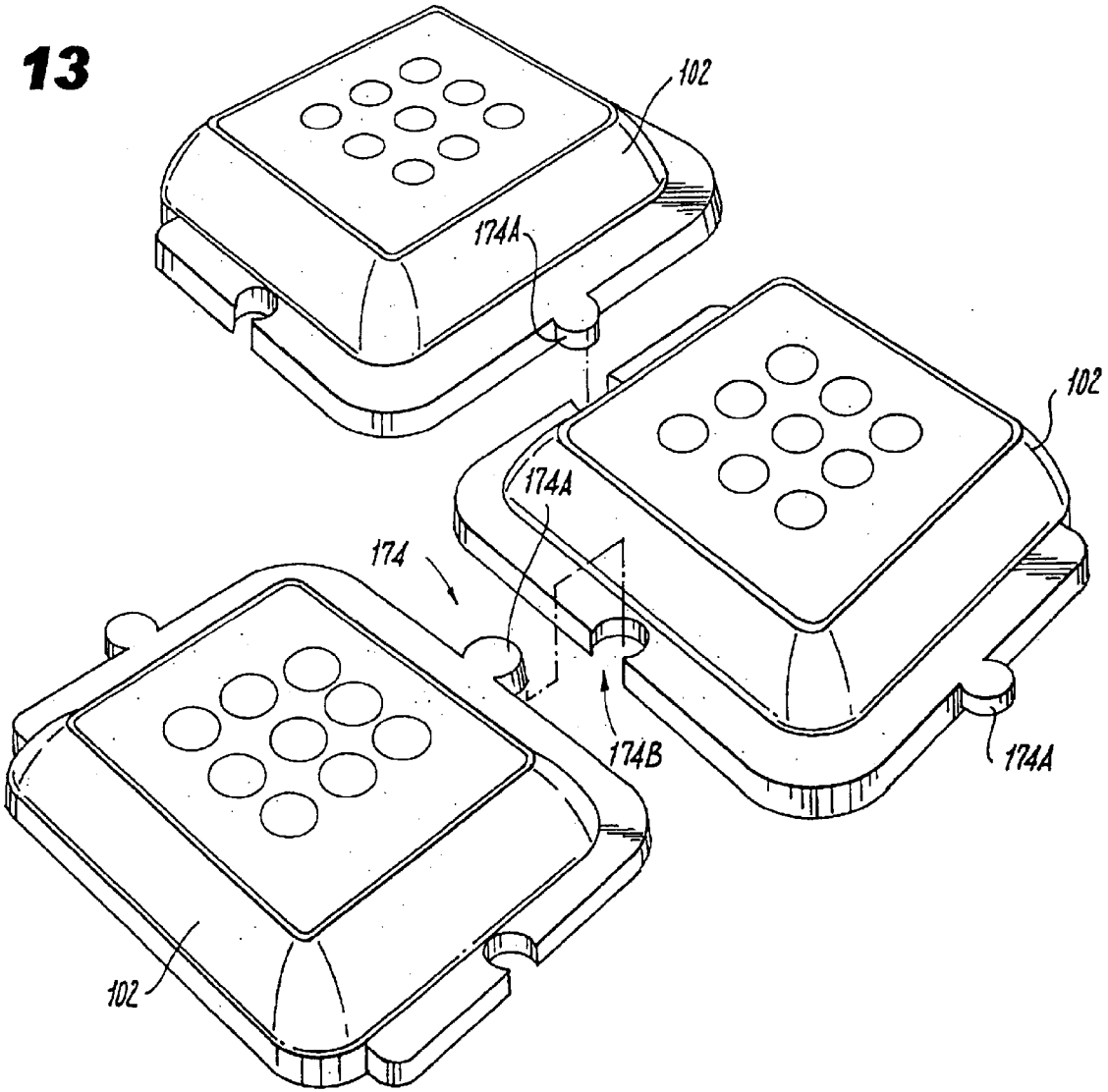
FIG. 13 is a front and side perspective view of another embodiment of the present invention.
Figure 14:
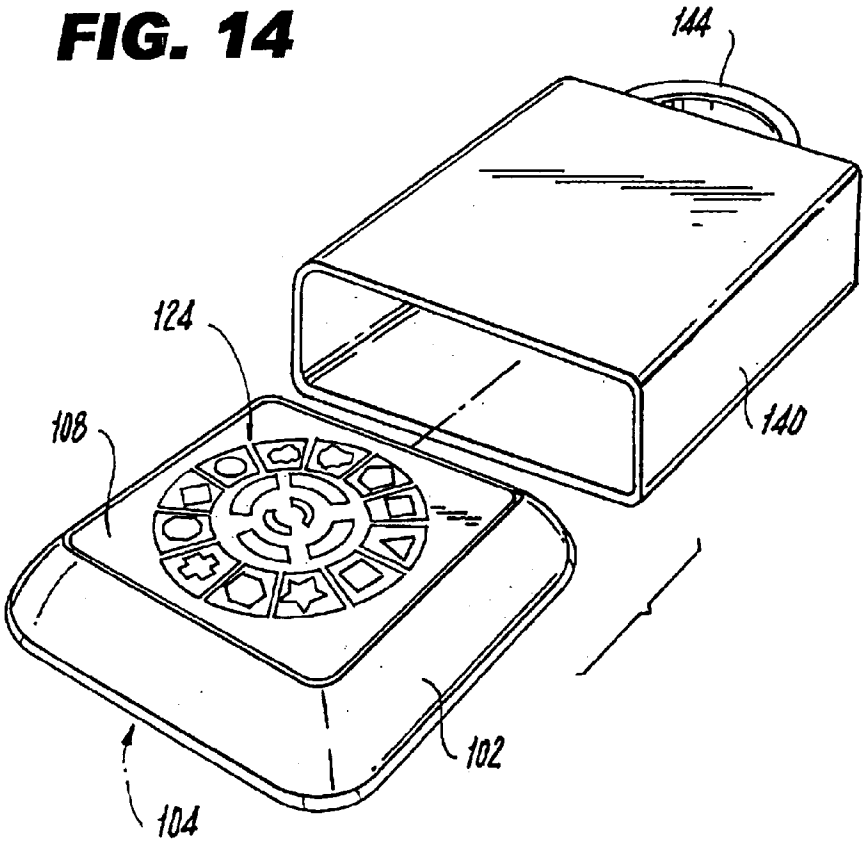
FIG. 14 is a front and side perspective view of another embodiment of the present invention.
Figure 15:
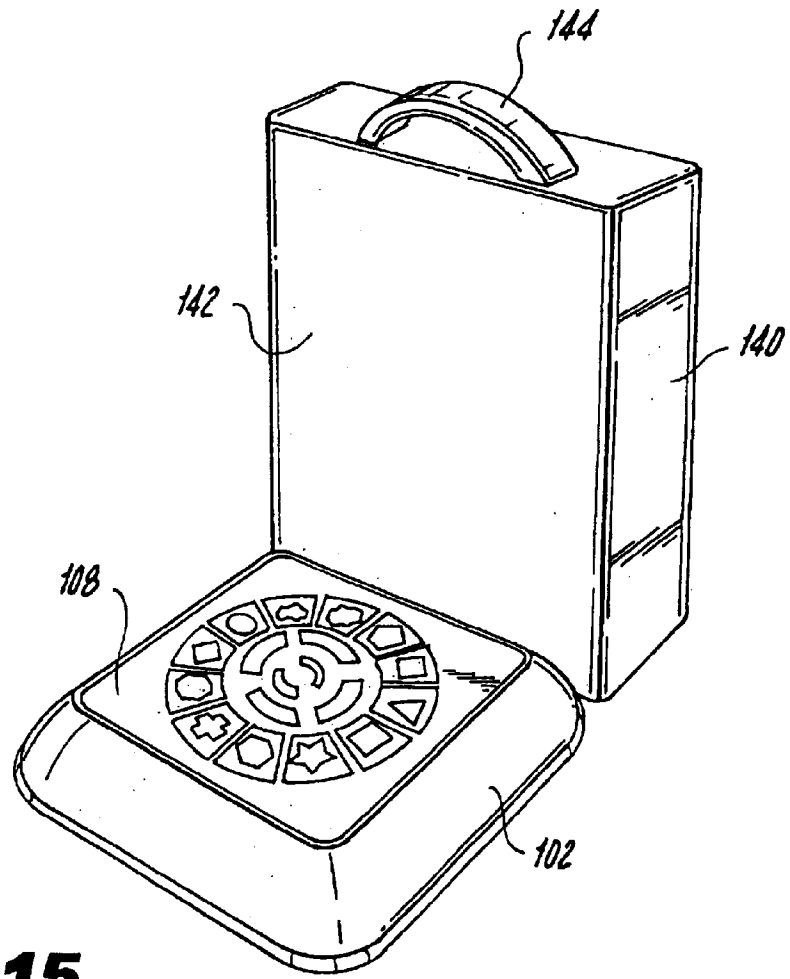
FIG. 15 is another front and side perspective view of the game device of FIG. 14.

Other preferred embodiments are illustrated in FIGS. 12 and 13. The game device 100 further includes an interconnect point 174. Interconnect point 174 is integrally connected to the housing 102 and may be either a protrusion 174A or a recess 174B. It is appreciated that the game device 100 may have numerous alternating interconnect points 174 (see FIG. 13). The interconnect points 174 are designed so the protrusion 174A of one game device 100 connects with the recess 174B of another the game device. Another embodiment connects multiple game devices 100 by a connection biscuit 176. The connection biscuit 176 connects the recess 174B of one game device 100 with the recess 174B of another game device 100A (see FIG. 12). The connections between game devices 100 may be mechanical or electro-magnetic. Regardless of the type of connection, the game device 100 may also include a device for determining the connection to another game device. This connection may allow the game devices 100 to work cooperatively. This determination may be preformed regardless if the connection is made directly or if the game device 100 detects the connection biscuit 176.

Figure 8:
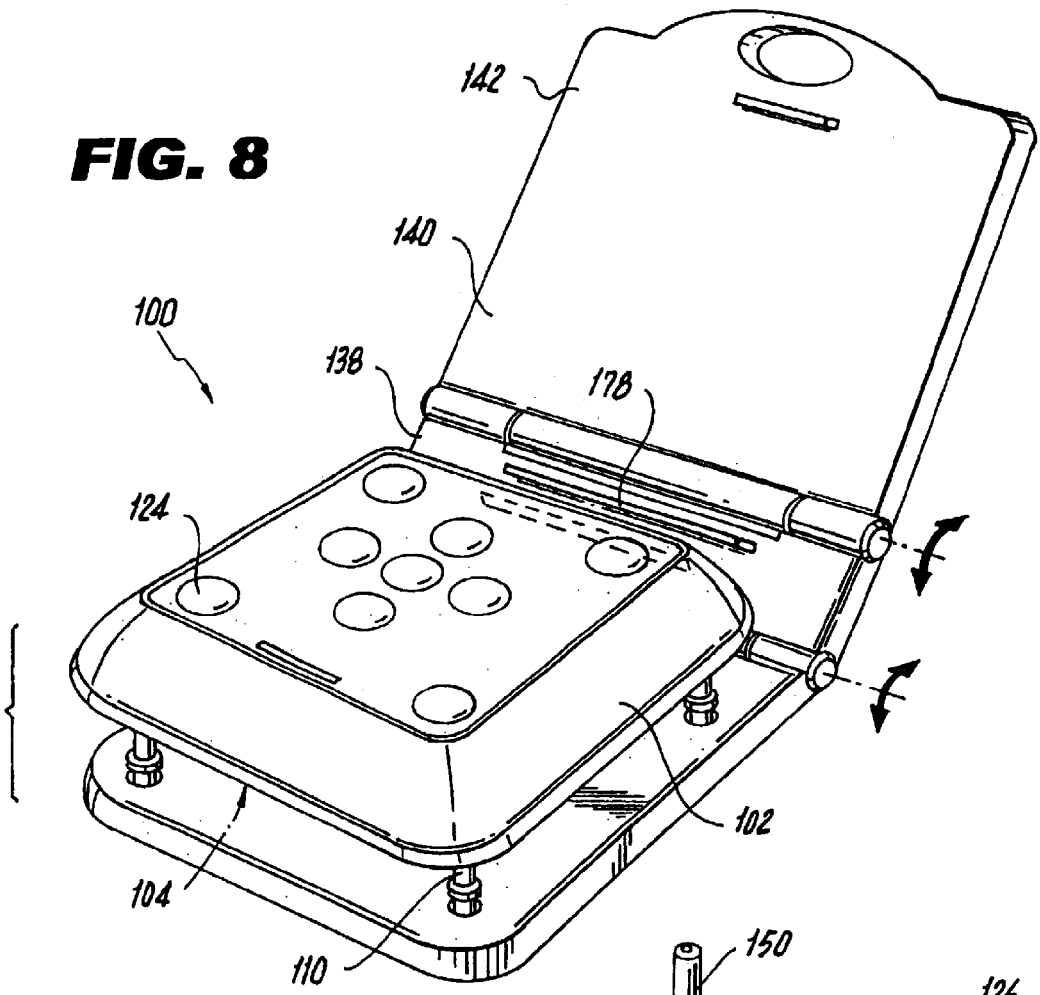
FIG. 8 is a front and side perspective view of another embodiment of the present invention.

Referring now to FIG. 8, when the game device 100 includes an interconnection point 174, the backing further may include an interconnection mirror element 178 Mirror element 178 is a protrusion 178A when the interconnection point is the recess 174B. Conversely, when the interconnection point 174 is a protrusion 174A, the mirror element 178 is a recess 178B and the interconnection mirror element may be integral to the backing.

Regardless of the embodiment, the preferred use of the game device 100 is to throw the ball 126 at the gaming surface 108 in an attempt to strike a contact surface 124. This method of play can be individual, 1-on-1, 2-on-2, or teams. For multi-user play, the users may be located on opposite sides of the game device 100, either square to the game device 100 or at a diagonal. The design of the game device 100 allows the ball 126 to bounce off the gaming surface 108 and to the opposing user. Multiple scoring devices may be utilized to record scores for different users. Additionally, scoring may be recorded differently for differing victory conditions. Specific victory conditions include, changing the position a particular pattern of contact surfaces 124, changing the position of the greatest number of contact surfaces 124, changing the positions of the most contact surfaces 124 in the shortest amount of time, each user changing the position of only a specified contact surface 124 while only a central contact surface registers the position change and others are contemplated.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

What is claimed is:

1. A game device for playing on a variable surface comprising:

a housing defining an interior chamber open to said variable surface, said housing having a top surface;

a gaming surface integral to said top surface of said housing and including a plurality of contact surfaces, said contact surfaces disposed in a pattern;

a leg being slidably connected to said housing, said leg being slidable between a first position interior to said housing and a second position at least partially exterior to said housing;

wherein said contact surfaces have a neutral position, a positive position and a negative position, wherein said contact surfaces are pressure sensitive and said pressure causing said contact surfaces to switch between said positions.

2. A game device as defined in claim 1, further comprising:

a base element being selectively disposed within said interior chamber of said housing, said base element having a portion extending exterior to said housing and engaging with said variable surface to support said housing.

3. The game device as defined in claim 2, wherein the base element further comprises:

a flexible container, said container defining a second interior chamber, wherein said container being conformable to said interior chamber of said housing, wherein said second interior chamber of said container is filled with a stabilizing material.

4. The game device as defined in claim 3, wherein said stabilizing material is selected from the group comprising sand, a solid, a granular material, a positively buoyant material, a liquid, a viscoelastic gel and a gas.

5. The game device as defined in claim 3, wherein said stabilizing material is air and said container further comprises a valve, wherein said valve has a open position and a closed position, said open position allowing for the passage of said air and said closed position restricting the passage of said air.

6. The game device as defined in claim 5, wherein said valve also comprises an air compression unit to force air through said valve.

7. The game device as defined in claim 3, wherein said flexible container having a toroidal shape.

8. The game device as defined in claim 3, wherein the stabilizing material is a buoyant granule plastic.

9. The game device as defined in claim 1, further comprising a leg being slidably connected to said housing, said leg being slidable between a first position interior to said housing and a second position at least partially exterior to said housing wherein said leg is are telescopic.

10. The game device as defined in claim 1, wherein said housing is positively buoyant in water.

11. The game device as defined in claim 1, wherein said pressure to said contact surfaces being applied by a ball.

12. The game device as defined in claim 1, wherein said contact surfaces are electro-mechanical;

said contact surfaces comprising of a plurality of indicators, said indicators comprising a plurality of colored lights, one said color light indicating one said position.

13. The game device as defined in claim 1, wherein said contact surfaces comprise a plurality of sound generating elements, wherein each position generates a distinct sound from said sound generating element.

14. The game device as defined in claim 1, wherein the gaming surface comprises a means for tallying a score.

15. The game device as defined in claim 1, wherein said housing also comprises a near end and a far end, said game device further comprising a backing having an impact surface, said backing being connected to said far end of said housing so said impact surface is perpendicular to said gaming surface and is directed toward said near end.

16. The game device as defined in claim 15, wherein said backing is electro-mechanically connected to said gaming surface.

17. The game device as defined in claim 15, wherein said backing being detachable from said housing.

18. The game device as defined in claim 15, wherein said backing further comprises a handle.

19. The game device as defined in claim 15, wherein said backing is engagable to said gaming surface, wherein said backing partially conceals said gaming surface.

20. The game device as defined in claim 15, wherein said backing is engagable to said leg, wherein said backing partially conceals said interior of said housing.

21. The game device as defined in claim 15, further comprising slide rails, wherein said backing being slidably connected to said slide rails.

22. The game device as defined in claim 15, wherein said backing is concurrently engageable to both the gaming surface and the leg, said backing being detachable.

23. The game device as defined in claim 1, wherein the gaming surface further comprises a goal post, said goal post being integral to said gaming surface and extending perpendicular to the gaming surface.

24. The game device as defined in claim 23, wherein said goal post being detachable from said gaming surface.

25. The game device as defined in claim 24, wherein said detachable goal posts can be disposed within said interior.

26. The game device as defined in claim 23, wherein said goal posts further comprise a motion sensor.

27. The game device as defined in claim 23, wherein said goal posts having a fixed end, wherein said housing further comprises a socket, said socket having a motion sensor; and said fixed end of said goal posts being engaged in said socket of said housing, wherein motion of said goal post activates said motion sensor.

28. The game device as defined in claim 23, wherein said backing further comprises:

a plurality of impact surfaces, said impact surfaces disposed in a pattern, wherein said impact surfaces have a neutral position, a positive position and a negative position, wherein said impact surfaces are pressure sensitive and said pressure causing said impact surfaces to switch between said positions.

29. The game device as defined in claim 28, wherein said backing further comprising:

a removable backing pattern plate, said removable backing pattern plate is removably connected to said impact surface of said backing, said removable backing pattern plate comprises a backing pattern, said backing pattern being approximately similar to said pattern of said impact surfaces;

a backing pattern plate detector, said detector having means for determining said backing pattern on said backing pattern plate.

30. The game device as defined in claim 23, wherein said goal posts further comprise:

one of a focused light emitting element and a focused light reflecting element;

wherein said focused light emitting element projects a focused beam of light directed at said focused light reflecting element, said beam of light creating a photoelectric barrier between said focused light emitting element and said focused light reflecting element, wherein said focused light emitting element being capable of detecting and signaling when said photoelectric barrier is disturbed.

31. The game device as defined in claim 1, wherein said contact surfaces further comprise a shape, said shape is selected from the group comprising triangles, squares, circles, ovals, polygons, trapezoids, wedges and arc sections.

32. The game device as defined in claim 31, wherein said pattern comprises an equal number of said contact surfaces disposed equally spaced in a rectilinear grid.

33. The game device as defined in claim 31, wherein said pattern comprises a plurality of contact surfaces disposed in a circular formation.

34. The game device as defined in claim 33, wherein said pattern further comprises a plurality of contact surfaces disposed in a concentric circular formation.

35. The game device as defined in claim 34, wherein said pattern further comprises a contact element disposed in the center of the circular formation.

36. The game device as defined in claim 31, wherein said pattern comprises said contact surfaces disposed in a rectilinear grid.

37. The game device as defined in claim 1, wherein the housing further comprises a selection element, said selection element comprising of a first position and a second position, wherein said first position activates said contact surfaces;

wherein said second position deactivates said contact surfaces.

38. The game device as defined in claim 37, wherein said selection element further comprises a plurality of positions, said positions altering said pattern of said contact surfaces.

39. The game device as defined in claim 38, wherein said positions of said selection element selectively activates predefined pattern of said contact surfaces.

40. The game device as defined in claim 39, wherein said gaming surface further comprising a removable surface pattern plate, said removable surface pattern plate is removably connected to said gaming surface, wherein said removable surface pattern plate comprises a surface pattern, said surface patten being approximately similar to said pattern of said contact surface.

41. The game device as defined in claim 40, wherein said surface pattern being approximately similar to said predefined pattern of said contact surfaces.

42. The game device as defined in claim 1, wherein said housing further comprises an interconnect point, said interconnect point integrally connected to said housing.

43. The game device as defined in claim 42, wherein said interconnect point being one of a protrusion and a recess.

44. The game device as defined in claim 43, wherein said protrusion of one said game device connects with said recess of another said game device.

45. The game device as defined in claim 44, wherein said connection being electro-magnetic.

46. The game device as defined in claim 44, wherein one game device further comprises means for determining the connection to another said game device.

47. The game device as defined in claim 43, further comprising a connection biscuit, said connection biscuit connecting said recess of one said game device with said recess of another said game device.

48. The game device as defined in claim 47, wherein one game device further comprises means for determining the connection to another said game device by detecting said connection biscuit.

49. The game device as defined in claim 43, wherein said backing further comprises an interconnection mirror element, said mirror element being a protrusion when said interconnection point being said recess;

wherein said mirror element being a recess when said interconnection point being said protrusion;

wherein said interconnection mirror element being integral to said backing.

50. The game device as defined in claim 1, wherein said gaming surface further comprising:

a removable surface pattern plate, said removable surface pattern plate is removably connected to said gaming surface, said removable surface pattern plate comprises a surface pattern, said surface pattern being approximately similar to said pattern of said contact surface;

a surface pattern plate detector, said detector having means for determining said surface pattern on said surface pattern plate.

51. The game device as defined in claim 50, wherein said detector further comprises means for selectively activating said contact elements to form said pattern to approximate said surface pattern.

* * * * *